United States Patent [19]

Hanson

[11] 4,202,066

[45] May 13, 1980

[54] METHOD OF HEAT SETTING FOOTWEAR

[75] Inventor: Raymond Hanson, Rearsby, England

[73] Assignee: USM Corporation, Farmington, Conn.

[21] Appl. No.: 898,177

[22] Filed: Apr. 20, 1978

[30] Foreign Application Priority Data

Jul. 20, 1977 [GB] United Kingdom ..... 31030/77

[51] Int. Cl.[2] ..... A43D 9/00

[52] U.S. Cl. ..... 12/142 R; 12/1 A

[58] Field of Search ..... 12/1 R, 1 A, 51, 59.7, 12/41.5, 142 R

[56] References Cited

U.S. PATENT DOCUMENTS

| | | | |
|---|---|---|---|
| 3,290,708 | 12/1966 | Spencer | 12/1 A |
| 3,739,413 | 6/1973 | Freeman | 12/1 A |
| 3,744,073 | 7/1973 | Nelson et al. | 12/1 A |

*Primary Examiner*—Patrick D. Lawson

*Attorney, Agent, or Firm*—Owen J. Meegan; Richard B. Megley; Vincent A. White

[57] ABSTRACT

A method of rapidly heat setting a shoe on a last wherein the shoe is subjected to dry air at elevated temperature, the air moving at a velocity at the shoe exterior of not less than five (5) meters per second for not more than three and one-half minutes. The method achieves shape retention in a lasted upper with improved efficiency.

3 Claims, 4 Drawing Figures

METHOD OF HEAT SETTING FOOTWEAR

BACKGROUND OF THE INVENTION

The present invention is concerned with improvements in or relating to heat setting, in particular the heat setting of shoes in the course of manufacture. The word "shoe" is used herein generically to include outer footwear generally whether completed or in the course of its manufacture.

Heat setting is an operation frequently performed in the manufacture of shoes to hasten shape retention of a lasted shoe upper and thus reduce the time the shoe has to remain on the last. A satisfactory heat setting technique entails relieving the stresses set up in a shoe upper which has been lasted. Radiant heating has been used for heat setting purposes but entails a danger of localized overheating and discoloring of some upper materials. A common prior heat setting technique comprises subjecting lasted shoes to a humid and then a dry atmosphere. There is disclosed in United Kingdom patent specification No. 1,081,613, for example, a method of setting a lasted shoe upper in which a lasted shoe is passed through a first chamber in which a humid atmosphere is provided, and then through a second chamber in which hot dry air is circulated.

While in said specification it is stated that hot air is directed into the second chamber at a velocity of about 75 feet per second (about 23 meters per second), it is found that by the time the air reaches the surface of a shoe upper being treated the actual air velocity is only 2 meters per second or less.

The apparatus described in said specification is somewhat complex and expensive, and in general use requires, when utilizing a humid atmosphere followed by a dry conditioning atmosphere, about 5 minutes treatment of a shoe to produce an acceptable degree of set of the shoe upper.

SUMMARY OF THE INVENTION

In view of the foregoing, one of the objects of the present invention is to provide a method of heat setting lasted shoe uppers which is more economical in operation.

I have found that, providing the conditions are appropriately selected and controlled, an acceptable degree of set of a leather shoe upper may be achieved in a desirably short time utilizing a flow of hot dry air only, that is to say, air drawn from the surrounding atmopshere in the work room and heated and to which no moisture has been purposely added. These good results have been achieved utilizing air flows which provide an air velocity at the surface of the upper of a shoe being set not less than 5 meters per second, specifically in the range of 5.2 to 7 meters per second, the shoe usually being conveyed bottom down and the ambient temperature surrounding the shoe being in the range of 120° C.–130° C. For example, where a leather upper was so treated in a manner where the velocity of the air at the surface of the upper was 6 meters per second and the upper was treated for 2 minutes, a percentage set of 74 was obtained, utilizing a dome set method of measuring, measured 24 hours after carrying out the treatment. No damage to the upper material occurred. By extending the time for the treatment some improvement in set results can be achieved, for example, after three and a half minutes of the treatment, percentage sets of 78 were recorded which appeared to be near the optimum for the leathers treated. Percentage sets of 70, pursuant to the industry standardized dome testing procedure which involves a clamped ring and hemispherical cooperating form, are regarded as good heat setting results in many cases.

In the present method, increasing the air velocity above 7 meters per second may further reduce the setting time to some extent, but it is believed that beyond a certain point increased air velocity will not necessarily effect quicker setting. Experiments show that more than doubling the air velocity to about 15 meters per second measured at the shoes operated on may achieve good sets in between eighty and ninety seconds but probably at the expense of increased running costs and unacceptable noise level of suitable apparatus for performing the operation.

I prefer an ambient temperature averaging 125° C. for working on leather and treatment above 130° C. may damage some leather uppers. An ambient temperature below 120° C. may be practical for achieving acceptable set results in some cases. For some non-leather uppers it is likely to be necessary to increase the temperature above 130° C.

The present invention provides, in one of its aspect, a method of heat setting a lasted shoe upper in which the upper is subjected to a dry air stream at an elevated temperature having a velocity not less than 5 meters per second, measured at the surface of the upper, for a time of not more than three and a half minutes.

The present invention provides, in another of its aspects, a method of heat setting a lasted shoe upper in which a lasted shoe is conveyed through a controlled jet of dry air at an elevated temperature having a velocity not less than 5 meters per second measured at the surface of the upper.

BRIEF DESCRIPTION OF THE DRAWINGS

The above and other of the various objects and the several aspects of the invention will become more clear from the following description, to be read with reference to the accompanying drawings, of a method of heat setting lasted shoes having leather uppers which is illustrative of the invention, and of an apparatus suitable for use in carrying out the illustrative method. The illustrative method has been selected to illustrate the invention by way of example and not by way of limitation thereof.

Figure 1:
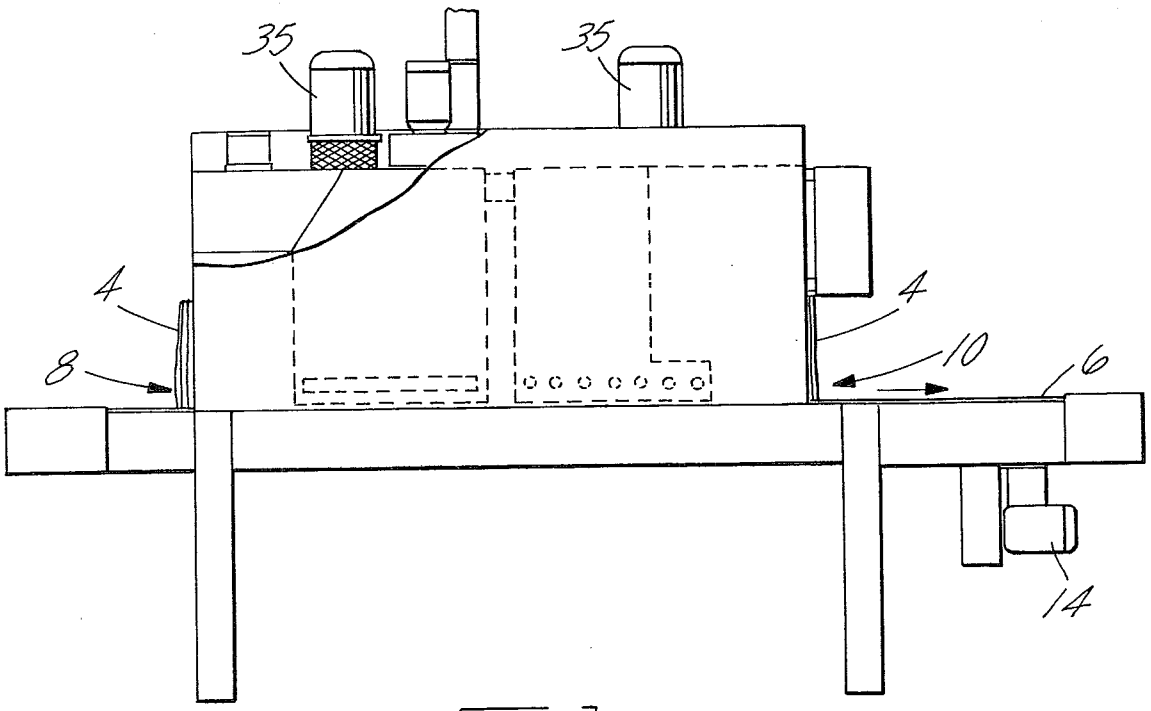
FIG. 1 is a view in side elevation of the illustrative apparatus.

The apparatus is constructed and arranged for use in carrying out the illustrative method and comprises a heating chamber in the form of a tunnel 2 (FIG. 3) having a plurality of split curtains 4 at each end which allow the passage of lasted shoes placed bottom down on a conveyor belt 6 (FIGS. 1–3) to enter the tunnel 2 at one end 8 and leave by an opposite end 10. The conveyor belt 6 is mounted on a frame of the apparatus at a convenient height for lasted shoes to be placed on the belt. The belt 6 is driven by means of a motor 14 (FIG.

1) to carry work placed on the belt through the heating chamber (rearwardly in FIG. 3) and the motor is desirably connected with the belt 6 through variable speed means which is adjustable to control the speed of movement of the belt. The belt preferably is wide enough to take six large size mens shoes placed side-by-side lengthwise in the direction of the belt travel.

Figure 2:
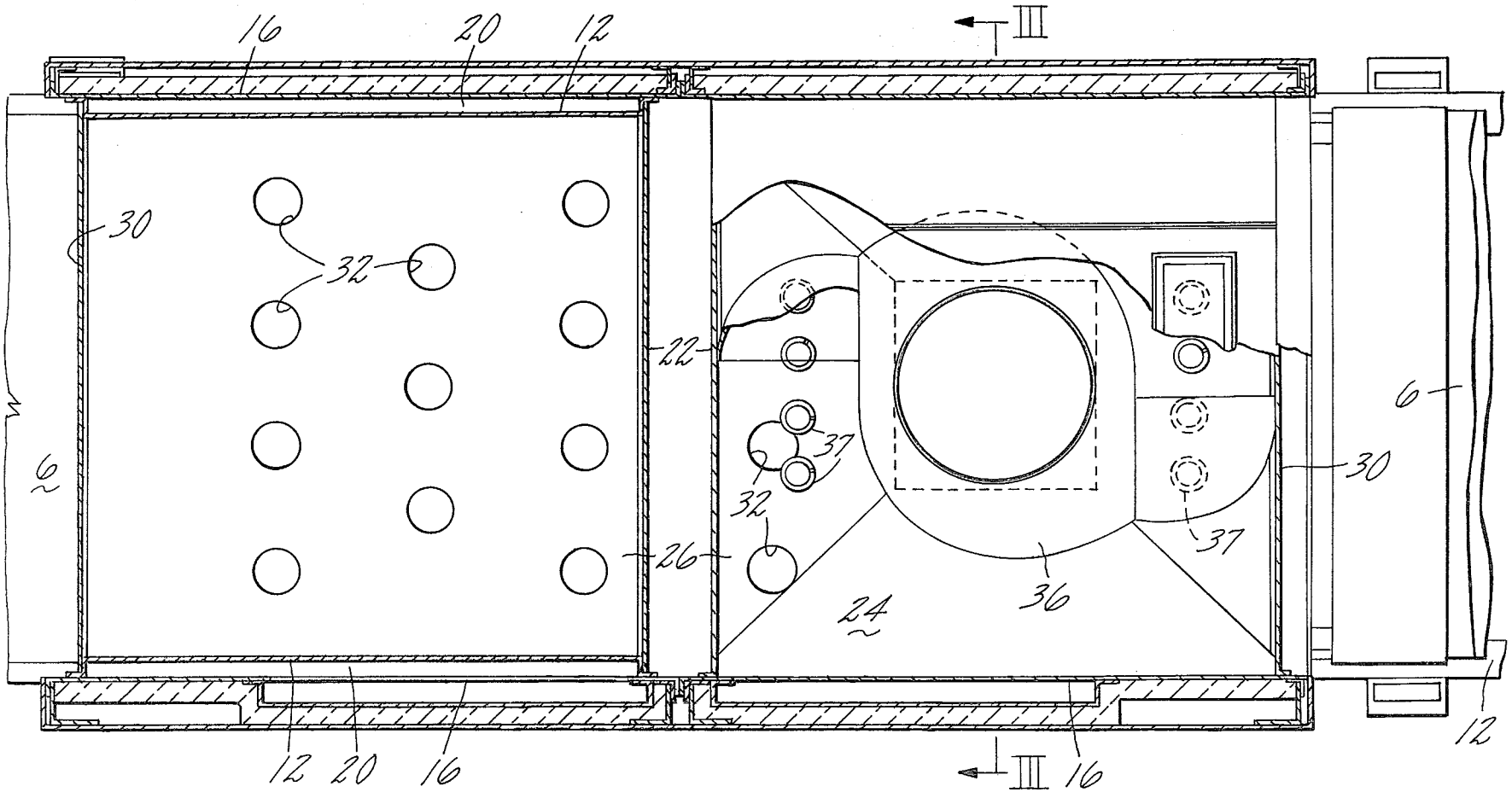
FIG. 2 is a plan view in section, and with portions broken away for clarity of construction of the apparatus of FIG. 1.
Figure 3:
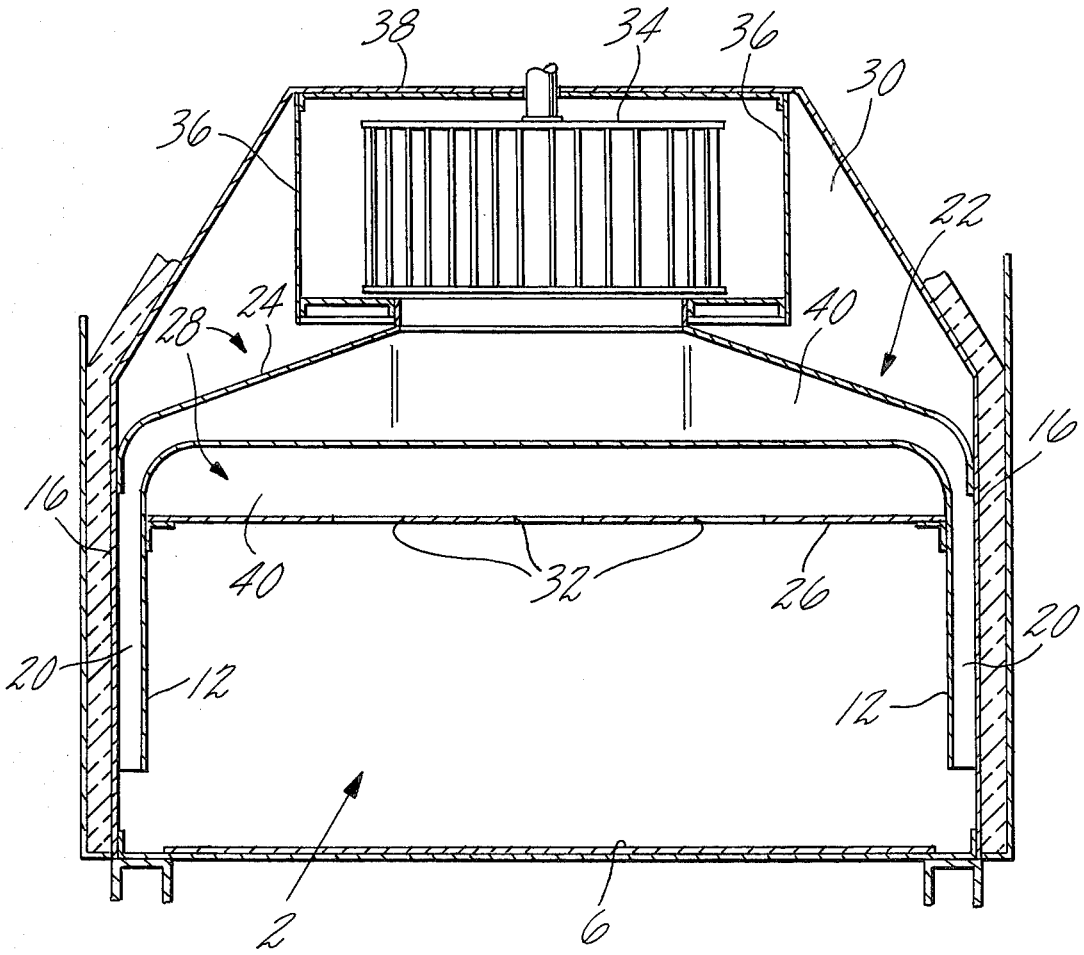
FIG. 3 is a sectional view of a portion of the apparatus viewed from an end thereof through which lasted shoes to be operated on are fed into the apparatus.
Figure 4:
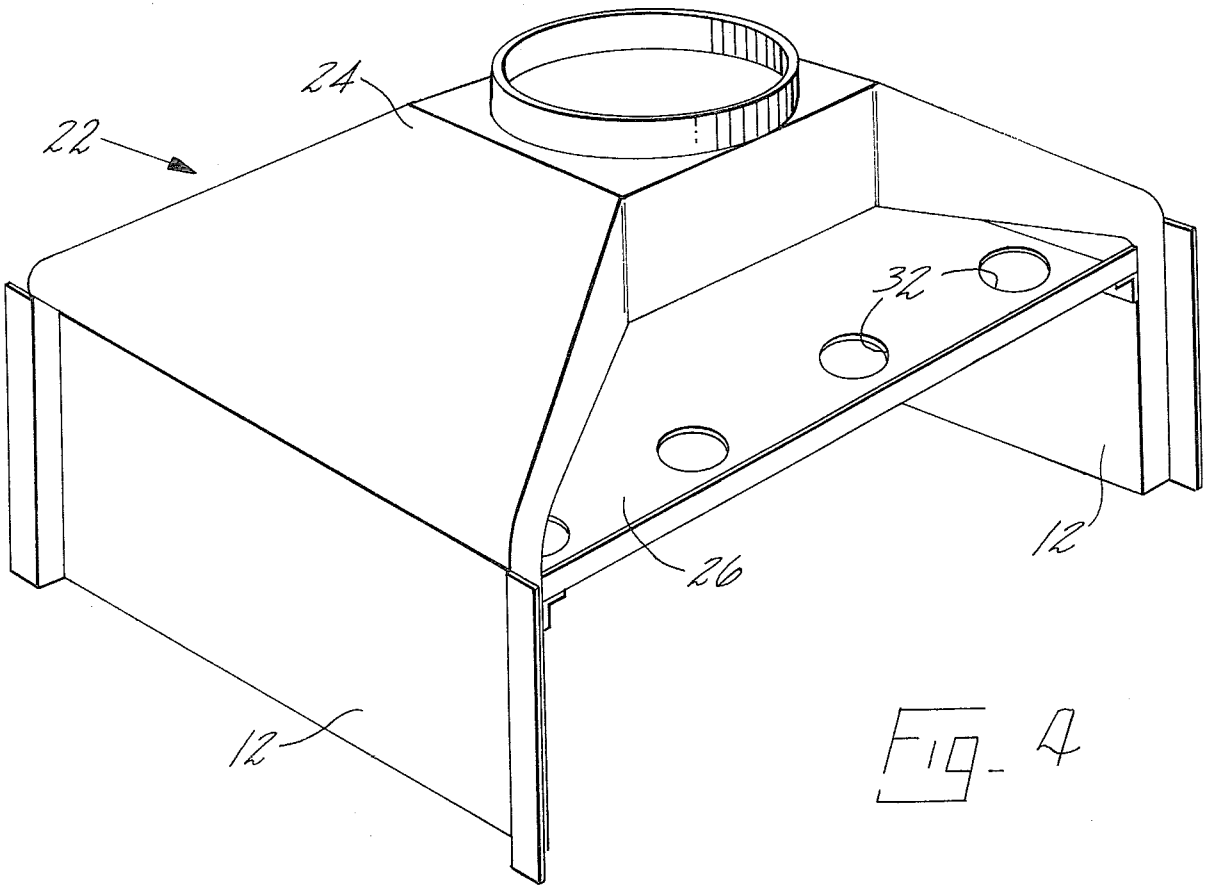
FIG. 4 is a perspective view of a unit of the apparatus.

The tunnel 2 straddles the belt 6 and is formed by two tunnel constructions mounted end-to-end lengthwise of the belt 6. Only one of the tunnel constructions can be seen in FIG. 3, the other lying behid as shown in FIG. 2. Insulated outer side wall assemblies include outer walls 16 of each tunnel construction and upwardly extending portions of the walls 16 at opposite sides of the tunnel are joined by roof portions 18 (FIG. 3). The tunnel 2 has cavity side wall portions forming return passages 20 for air on the opposite sides of the tunnel. The passages 20 are respectively formed between the outer side walls 16 and the inner side wall 12 (FIG. 3). The inner side walls 12 are formed on tunnel units 22, there being two of these tunnel units, one to each tunnel construction, fixed adjacent each other lengthwise of the belt 6.

Each tunnel unit 22 comprises opposite inner side walls 12 connected at their upper ends by a hollow bridge portion 24 (FIG. 3). A ceiling of the tunnel 2 comprises two nozzle plates 26 (FIG. 2), one in each unit 22, extending between the opposite inner side walls 12 and fixed thereto below the bridge portion 24. The nozzle plates 26 are spaced from the bridge portion 24, preferably at a height about ten inches above the belt 6, sufficient, for instance, to allow some bootees to pass through the tunnel. Two enclosed compartments 28,28 are formed above the tunnel, one above each nozzle plate 26 and enclosed by the nozzle plate, the associated roof portion and end walls 30. Air is drawn into the compartments 28 and expelled into the tunnel 2 through nozzle holes 32 (FIG. 3) in the nozzle plates 26. Each nozzle plate 26, for instance, may be twenty eight and a quarter inches wide and twenty nine inches in length, i.e. lengthwise in the direction of the belt travel, and have on the order of about eleven nozzle holes 22 spaced therein. Each nozzle hole 32 is desirably on the order of two and a half inches in diameter.

Mounted in each compartment 28 over the bridge portion 24 is a fan 34 driven by a motor 35 and rotatably mounted about a vertical axis in a fan scroll 36 having two outlets for air under pressure drawn into the scroll by means of the fan 34. Thermostatically controlled electric heaters 37 (FIG. 2) for heating the circulated air depend from each roof portion 38 fore and aft of the fans, and the scroll outlets are positioned fore and aft of the scrolls for air to be thrown in the direction of the heaters. Each fan 34 preferably has its own driving motor mounted on the associated roof portion 38.

Heated air under pressure in the compartments 28 is driven down into the tunnel 2 through the nozzle holes 32 in the form of jets. In the operative condition of the apparatus the velocity of air measured at the nozzle holes is desirably maintained in the range of 12.5–14.0 meters per second, enabling the air jets reaching to the belt 6 to have a velocity in the range 5.2–7.0 meters per second when measured in the region of the toes of shoes being conveyed by the belt 6 through the tunnel 2.

Heated air is recirculated, returning to the compartments, via the passages 20, passages 40 in the bridge portions 24, and fan scrolls 36. Bottom edges of the inner side walls 12 are spaced above the belt 6 to allow the air to enter the passages 11.

The illustrative method of heat setting is performed by placing lasted shoes having leather uppers bottom down on the belt 6 so as to be conveyed toe first through the tunnel 2. The belt is driven at a speed such that a shoe takes about two minutes to pass through the tunnel. Shoes conveyed through the tunnel are thus conveyed through controlled jets of dry heated air directed through the nozzle holes 22 at the shoes, the ambient termperature of the air in the tunnel being maintained in the range 120° C.–130° C. The velocity of the hot air jets in the region through which the toes of the shoes pass through the jets is maintained not less than 5 meters per second, specifically in the range 5.2–7.0 meters per second.

Percentage sets, measured twenty-four hours after the heat setting treatment and in accordance with standard dome test procedure, of more than 70 may be obtained using the illustrative method of heat setting on lasted shoes having leather uppers.

Having thus described my invention, what I claim as new and desire to secure as Letters Patent of the United States is:

1. The method of heat setting a lasted shoe upper comprising subjecting the upper to a dry air stream at an elevated temperature, and maintaining the air stream substantially at such elevated temperature while directing the air flow to the upper with a velocity not less than five (5) meters per second, as measured at the surface of the upper, for not more than three and one-half minutes.

2. The method of claim 1 wherein the air stream comprises at least one controlled jet of dry air having a temperature, while contacting the surface of the upper, in the range of about 120° C.–130° C.

3. The method of heat seating a lasted leather shoe upper for retension of shape in the toe portion of the upper, the steps which comprise: conveying the lasted shoe bottom down at selected variable speed through a dry air stream at an elevated temperature, said air stream being maintained at the point of contact with the upper at a temperature in the range of 120° to 130° C. and a velocity of not less than 5 meters per second for not more than 3½ minutes, said shoe being disposed at a substantially fixed distance from the force of said air stream.

* * * * *